US009151116B1

(12) United States Patent
Galvez

(10) Patent No.: US 9,151,116 B1
(45) Date of Patent: Oct. 6, 2015

(54) PORTABLE HARD ROCK DRILL RIG

(71) Applicant: Cesar Cortes Galvez, Richmond, CA (US)

(72) Inventor: Cesar Cortes Galvez, Richmond, CA (US)

( * ) Notice: Subject to any disclaimer, the term of this patent is extended or adjusted under 35 U.S.C. 154(b) by 403 days.

(21) Appl. No.: 13/740,653

(22) Filed: Jan. 14, 2013

Related U.S. Application Data

(60) Provisional application No. 61/586,646, filed on Jan. 13, 2012.

(51) Int. Cl.
*E21B 1/02* (2006.01)
*E21B 3/02* (2006.01)

(52) U.S. Cl.
CPC .... *E21B 3/02* (2013.01); *E21B 1/02* (2013.01)

(58) Field of Classification Search
CPC ..... E21B 1/02; E21B 3/02; E21B 7/02; E21B 7/022; E21B 7/025; E21B 15/003
See application file for complete search history.

(56) References Cited

U.S. PATENT DOCUMENTS

| | | | | |
|---|---|---|---|---|
| 4,161,988 | A | 7/1979 | Hart | |
| 4,192,393 | A | 3/1980 | Womack et al. | |
| 6,533,045 | B1 | 3/2003 | Cooper | |
| 6,848,515 | B2 | 2/2005 | Orr et al. | |
| 2005/0126821 | A1 * | 6/2005 | Davies | 175/20 |

OTHER PUBLICATIONS

Frank Marlow, "Welding Fabrication & Repair: Questions and Answers", May 2002, Industrial Press, inc., 1st Edition, pp. 206-209.*

* cited by examiner

*Primary Examiner* — Cathleen Hutchins
(74) *Attorney, Agent, or Firm* — Steven A. Nielsen; www.NielsenPatents.com

(57) ABSTRACT

A portable hard rock drill rig uses fluids for rotational power and compressed air to achieve a hammer affect. The drill rig is comprised of modular parts configured to allow one or two workers to move the rig over difficult terrain and to assemble the rig within a small area.

1 Claim, 25 Drawing Sheets

PORTABLE HARD ROCK DRILL RIG

CROSS-REFERENCE TO RELATED APPLICATIONS

This application is a utility application based upon and claims the priority date of U.S. patent application Ser. No. 61/586,646 filed on Jan. 13, 2012. This related application is incorporated herein by reference and made a part of this application. If any conflict arises between the disclosure of the invention in this utility application and that in the related provisional application, the disclosure in this utility application shall govern. Moreover, the inventor incorporates herein by reference any and all patents, patent applications, and other documents hard copy, electronically cited or referenced to in this application.

BACKGROUND OF THE INVENTION (1) Field of the Invention

The invention generally relates to earth drilling systems. More particularly, the invention relates to means and methods of creating portable and versatile earth drilling systems.

(2) Description of the Related Art

Other portable drilling systems are known in the related art. For example, U.S. Pat. No. 6,533,045 issued on Mar. 18, 2003 to Cooper discloses a mounting system secured to the bed of a truck.

U.S. Pat. No. 6,848,515 issued on Feb. 1, 2005 to Orr et al discloses a bulky transport structure to move drilling equipment.

U.S. Pat. No. 4,192,393 issued on Mar. 11, 1980 to Womack et al discloses a portable drilling system suited for helicopter transport.

U.S. Pat. No. 4,161,988 issued on Jun. 24, 1979 to Hart discloses a portable earth core sampling machine using an awkward frame system having a heavy piston component and a rope pulley system.

Thus, there is ample room in the art for the disclosed systems and methods.

BRIEF SUMMARY OF THE INVENTION

The present invention overcomes shortfalls in the related art by presenting an unobvious and unique combination and configuration of methods and components to create a relatively light weight, safe, transportable system that drives drill heads and other implements at virtually any angle. Disclosed embodiments may drill through solid rock material while requiring little work space. Disclosed embodiments comprise components that may be carried by one or two people, assembled in confined spaces and provide drilling with both hydraulic rotation with compressed air and/or fluid for an added hammer affect.

The disclosed embodiments overcome shortfalls in the related art by providing a modular drilling system that is relatively easy to transport and assembly but yet provides the hard rock penetration found in stationary rigs.

Components of the disclosed embodiments include a portable body assembly which may be braced at any angle to facilitate the drilling of tie backs and other specialty bores. A portable body assembly may be comprised of manageable components that may be bolted together, such components may comprise a sliding head base, head casing and a hydraulic motor base. Such components may slide up and down upon a rectangular frame.

A portable body assembly may use a rectangular frame as a support structure, with the rectangular frame having vertical members with "C" channels and bracing supports. A first chain or conveyer system may be used to transfer rotational movement from a hydraulic motor to a drilling head and a second chain or conveyer system may be used to lift and lower a sliding head base, head casing and a hydraulic motor base along a rectangular frame.

A configuration of support rods may be fastened to a portable body assembly to facilitate stable drilling upon uneven areas.

In the prior art, many portable drill rigs fail to provide air or water hammer movement which leads to unsatisfactory drilling performance. In the prior art portable drill rigs that do provide air or water hammer movement are too large and heavy to be truly portable. The present embodiments overcome shortfalls in the art by use of modular components, such as a sliding head base, head casing and hydraulic motor base to provide both air and water hammer features and portability.

To keep the weight of the head casing manageable, a separate hydraulic motor base is used to secure a hydraulic motor that rotates a chain to spin an adjacent bearing assembly contained within an adjacent head casing. Air and/or water pressure may be applied at the head casing and into a bearing assembly. A disclosed bearing assembly is easily removed from the head casing for transport and cleaning. Moreover, a disclosed bearing assembly efficiently conveys air and water hammer pressure to drilling and boring implements.

In the prior art, adding rods behind a descending drill head is often a laborious process, especially with other portable drill rigs of the prior art. Disclosed embodiments overcome such shortfalls by the artful placement, attachment and movement of a sliding base head along a rectangular frame. After a section of rod is drilled into the ground, the rod may be released and the sliding head base may be raised and another rod attached for further drilling. In recovering a drill head, the process is painlessly reversed.

In the prior art, placing a drill rig within a confined space can be challenging. This prior art shortfall is overcome by the disclosed configuration and use of an optional control station wherein fluid and air pressures may be controlled and marshaled at a distance from the drill rig or portable body assembly. A disclosed control station allows an operator to move the sliding base head up or down, control the rotational force applied to a drill head and control air and/or water hammer applied to a drill head.

Disclosed components and configurations of a portable body assembly also overcome shortfalls in the art by allowing drilling in horizontal to vertical positions and upon unstable and uneven set up surfaces. The lower sections of a portable body assembly use an unobvious combination of wheel base components with wheel base pins integrated into a rectangular frame. The disclosed configuration allows for quick wheel removal. The disclosed anchoring feet provide collars to contain support rods driven into the ground.

These and other objects and advantages will be made apparent when considering the following detailed specification when taken in conjunction with the drawings.

REFERENCE NUMERALS IN THE DRAWINGS

Figure 1:
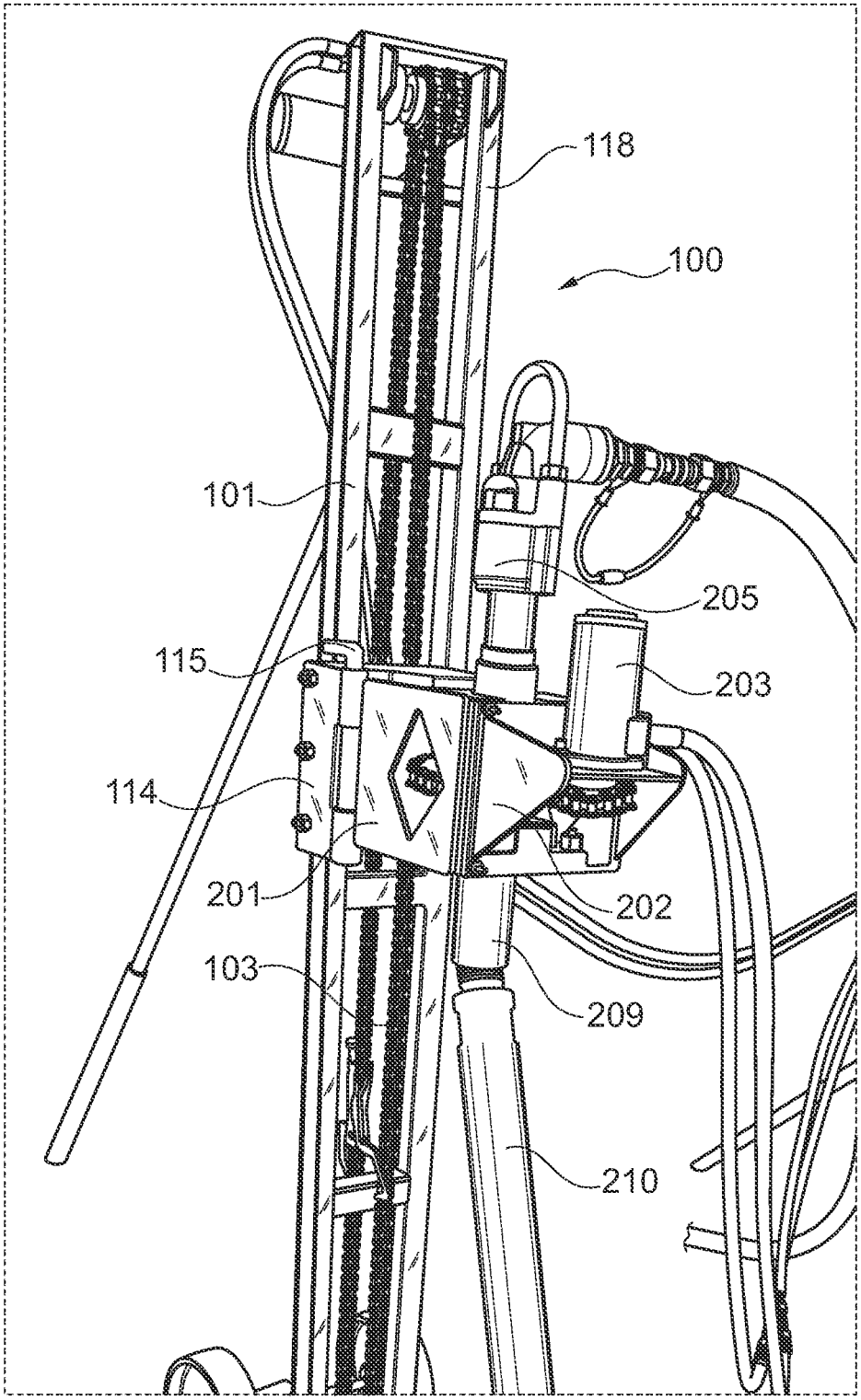
FIG. 1 depicts a top section of a portable body assembly

100 a portable body assembly
101 "C" channel
102 square tube
103 chain sometimes number 60 in size
104 round tube
105 anchoring foot
106 wheel base
107 wheel base pins
108 tripod anchor support
109 hydraulic motor
110 hydraulic hose sometime with quick couplers
111 hydraulic motor base
112 chain sprockets
113 bearing hubs
114 sliding head base
115 hand attachment pins
116 sliding head plastic rollers
117 guide with pins
118 rectangular frame
119 vertical members of the rectangular frame 118
120 cross bars of the rectangular frame 118
121 drill head assembly comprising a sliding head base
200 down hole hammer head
201 head casing
202 hydraulic motor base
203 hydraulic motor
204 hydraulic hoses
205 swivel
206 swivel hub
207 chain
208 sprockets
209 QL40 bar coupling
210 down hole hammer
211 J wrenches
300 rotary auger head
301 hydraulic motor
302 hydraulic hose sometimes with quick couplers
303 hydraulic motor base
304 yoke with two pieces sometimes with coupler
305 auger
306 grout injection swivel for micro piles
400 drifter head
401 head
402 coupler and rod
500 control unit
501 control valves
502 connections for controls
503 hydraulic power unit connections
504 control base
505 control base tripod
506 air compressor inlet sometimes with quick couplers
507 air outlet
508 "T" air or water mixer and outlet
509 water check valve
510 water flow control hose bib and inlet
511 hose sometimes with a quick coupler
600 pressure tank
601 air valve
602 tank
603 hose connectors
700 bearing assembly
701 outer collar housing
702 inner bearing
703 inner drive shaft with sprocket
704 second sprocket
705 first ring
706 second ring

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines.

FIG. 1 depicts portions of a portable body assembly 100 comprising a rectangular frame 118 with the two vertical legs of the rectangular frame configured into "C" channels 101.

In the foreground a hydraulic motor base 202 is attached to a head casing 201 with the head casing 201 attached to the vertical members 119 of the rectangular frame. A hydraulic motor 203 is shown in attachment to the hydraulic motor base 202. The hydraulic motor 203 rotates a sprocket attached to a chain which rotates a bar coupling 209. The bar coupling may be in attachment with a variety of boring or drilling tools as shown in subsequent drawings.

Figure 2:
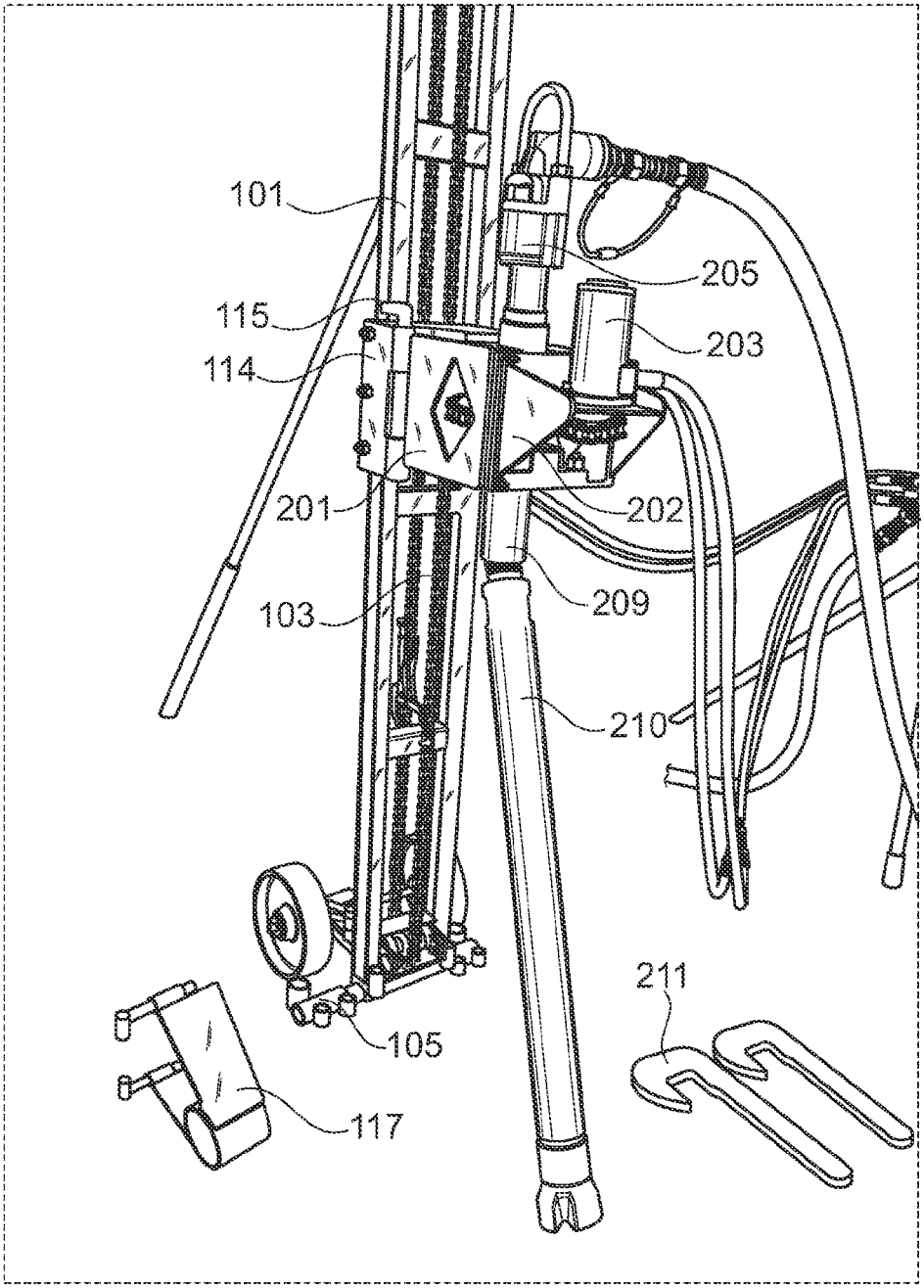
FIG. 2 depicts middle and bottom sections of a portable body assembly

FIG. 2 depicts a portable body assembly 100 comprising a rectangular frame with the rectangular frame comprising two vertical members 119 and a plurality of cross bars 120. In the foreground, a down hole hammer 210 is shown next to a bar coupling 209. Various hammers and other implements may be fitted into the bar coupling 209. The bar coupling 209 may move up and down along the rectangular frame to facilitate adding extension bars or other implements to accommodate additional depths of a drilling operation.

A swivel hub is attached to a swivel with accepts an air hose supplying air pressure to the bearing assembly 700. A head casing 201 houses and retains the bearing assembly 700.

Figure 3:
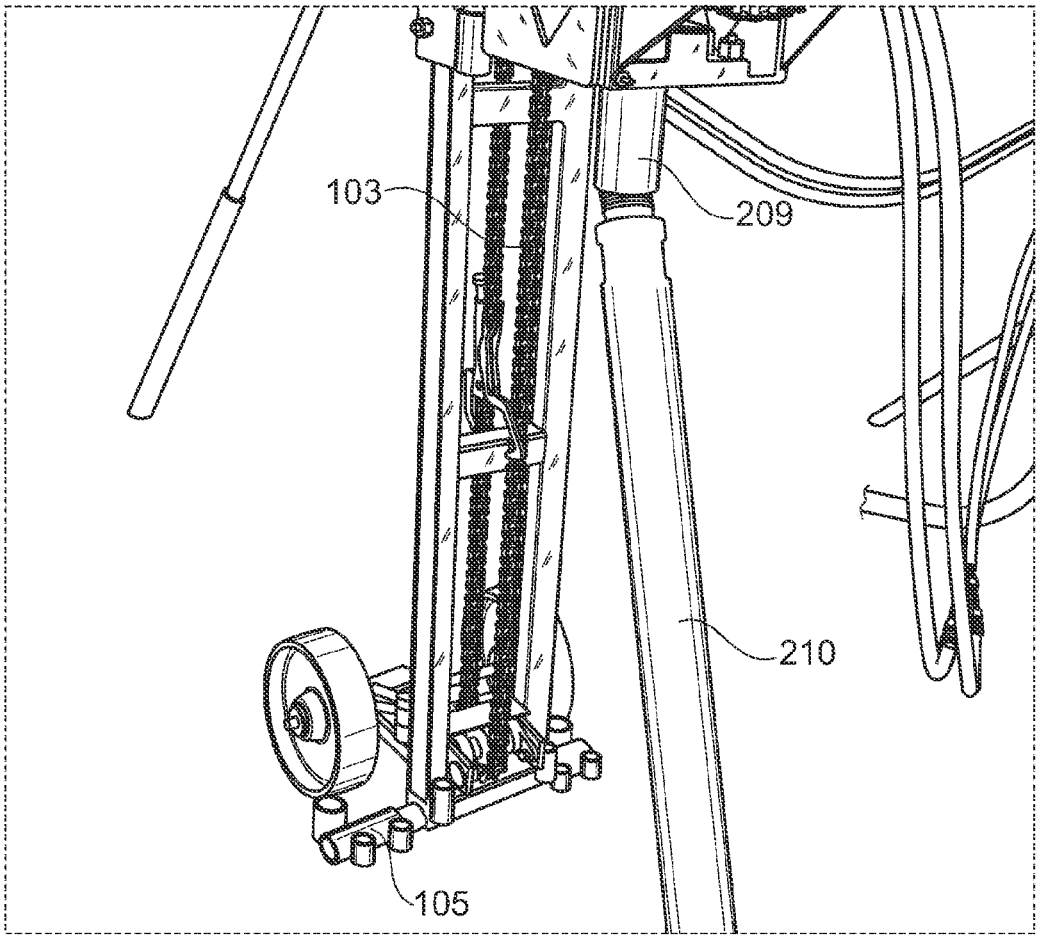
FIG. 3 depicts a middle section of a portable body assembly

FIG. 3 depicts a hole hammer 210 attached to a bar coupling 209. In the back ground a chain is shown between the vertical members 119 of the rectangular frame. The chain moves the sliding base head 114 up and down.

Figure 4:
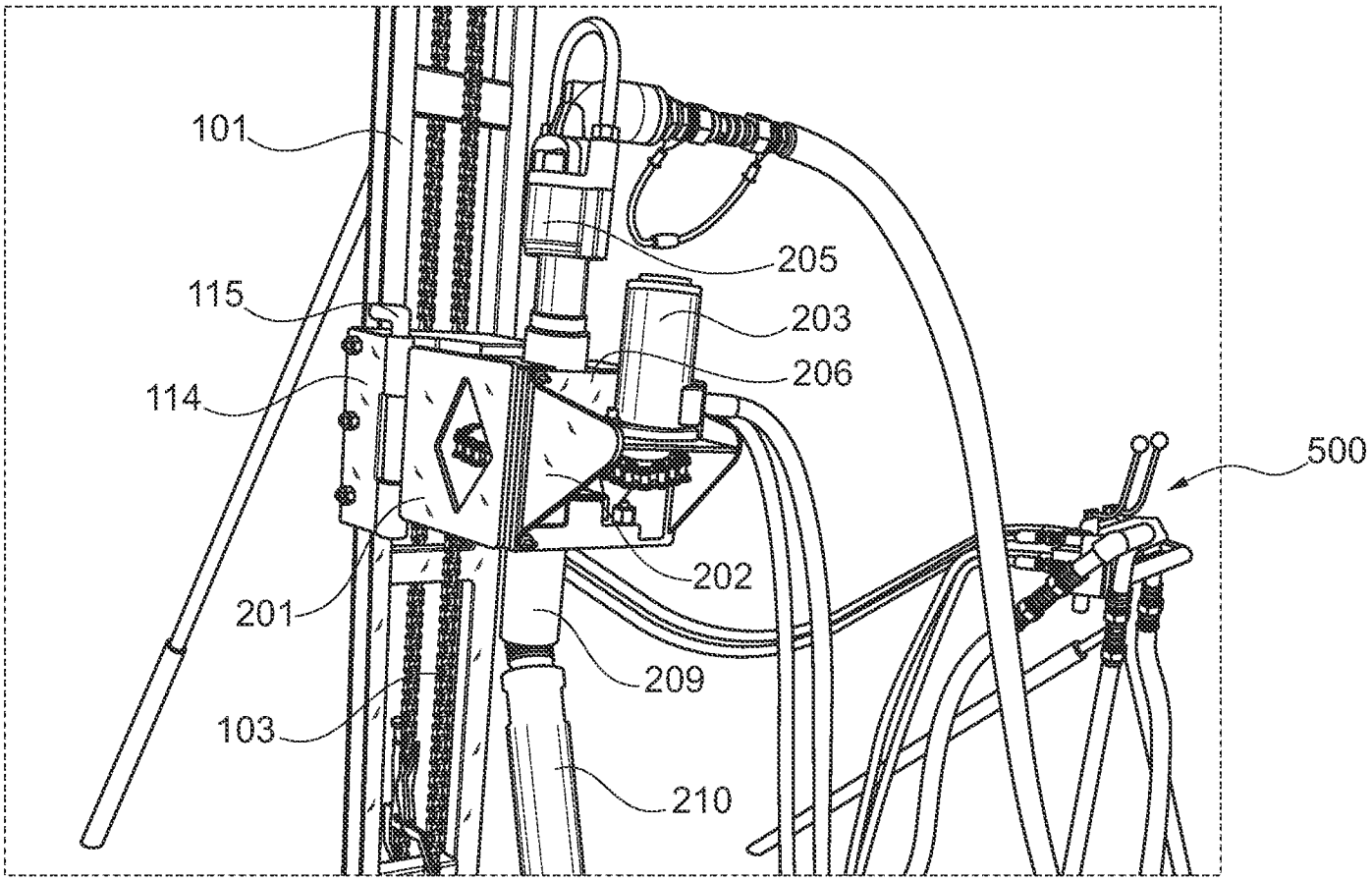
FIG. 4 depicts a middle perspective view of a portable body assembly
Figure 5:
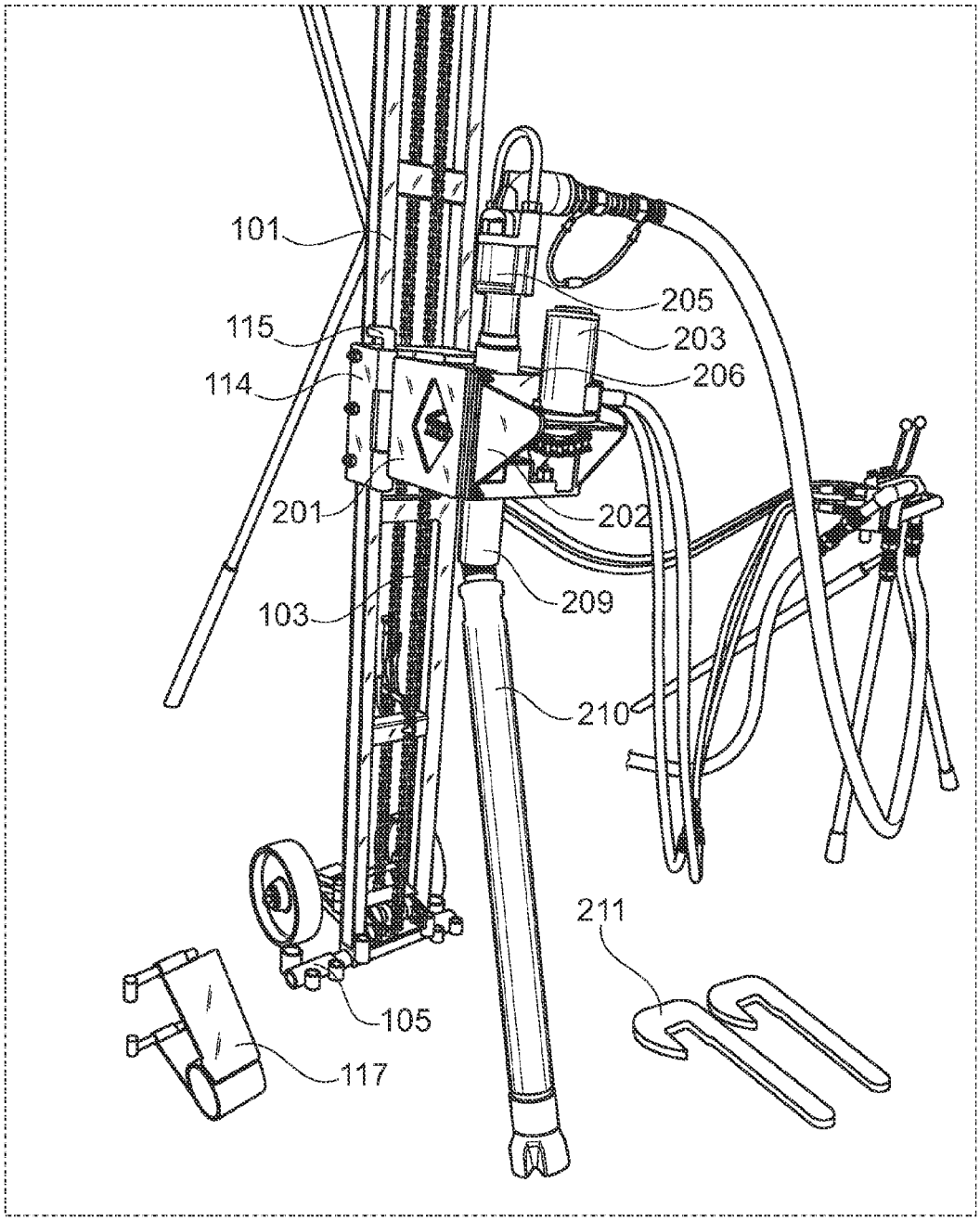
FIG. 5 depicts a portable body assembly and control assembly

FIG. 4 depicts a sliding base head 114 moveably attached to a rectangular frame, a head casing attached to the sliding base and the head casing FIG. 5 depicts a plurality of hoses attached to a portable body assembly and a control unit 500. In general, an operator standing near the control unit 500 may cause the bar coupling to raise up or down, control the air pressure applied to the bearing assembly 700, and control the hydraulic pressure rotating the bar coupling. The configuration of the control unit allows for the portable body assembly to be fitted into tight places as the controls may be placed separately within a radius constricted only by the length of available hoses.

Figure 6:
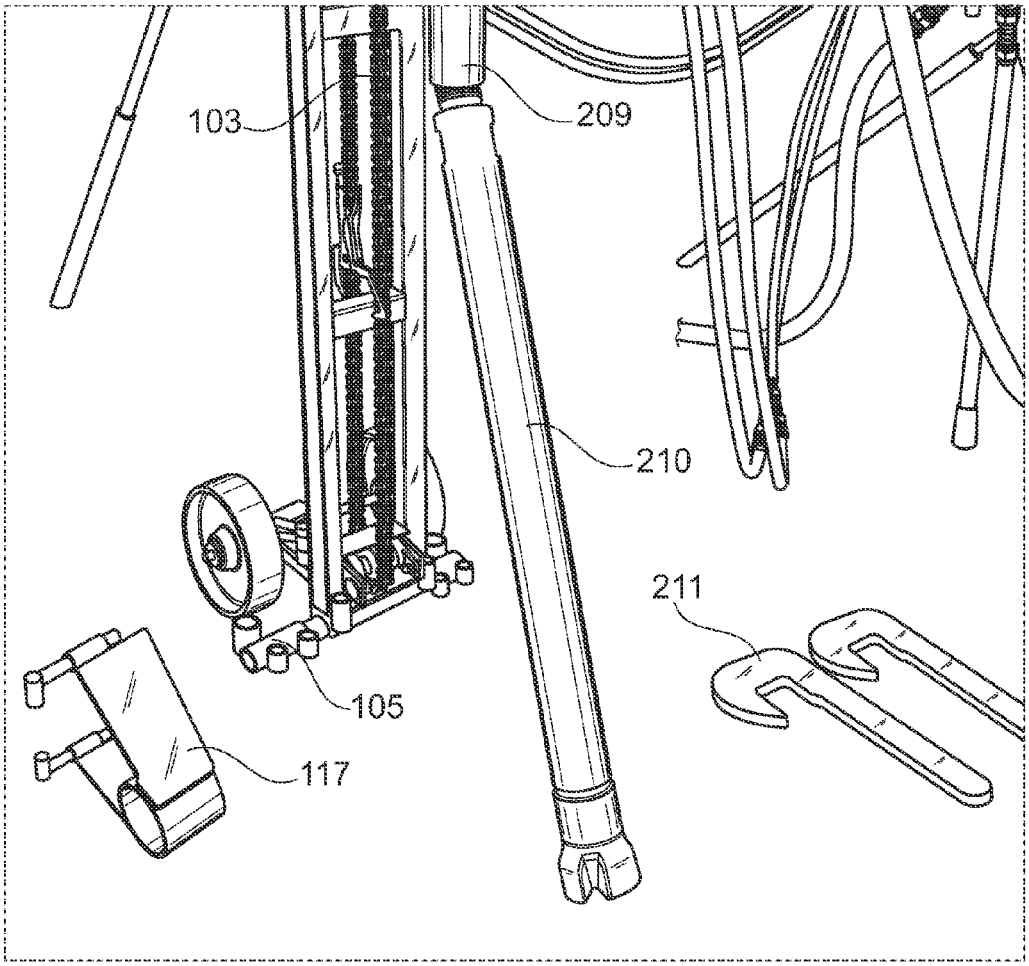
FIG. 6 depicts a bottom section of a portable body assembly

FIG. 6 depicts an guide with pins 117, two or more anchoring feet 105, and a pair of "J" wrenches.

Figure 7:
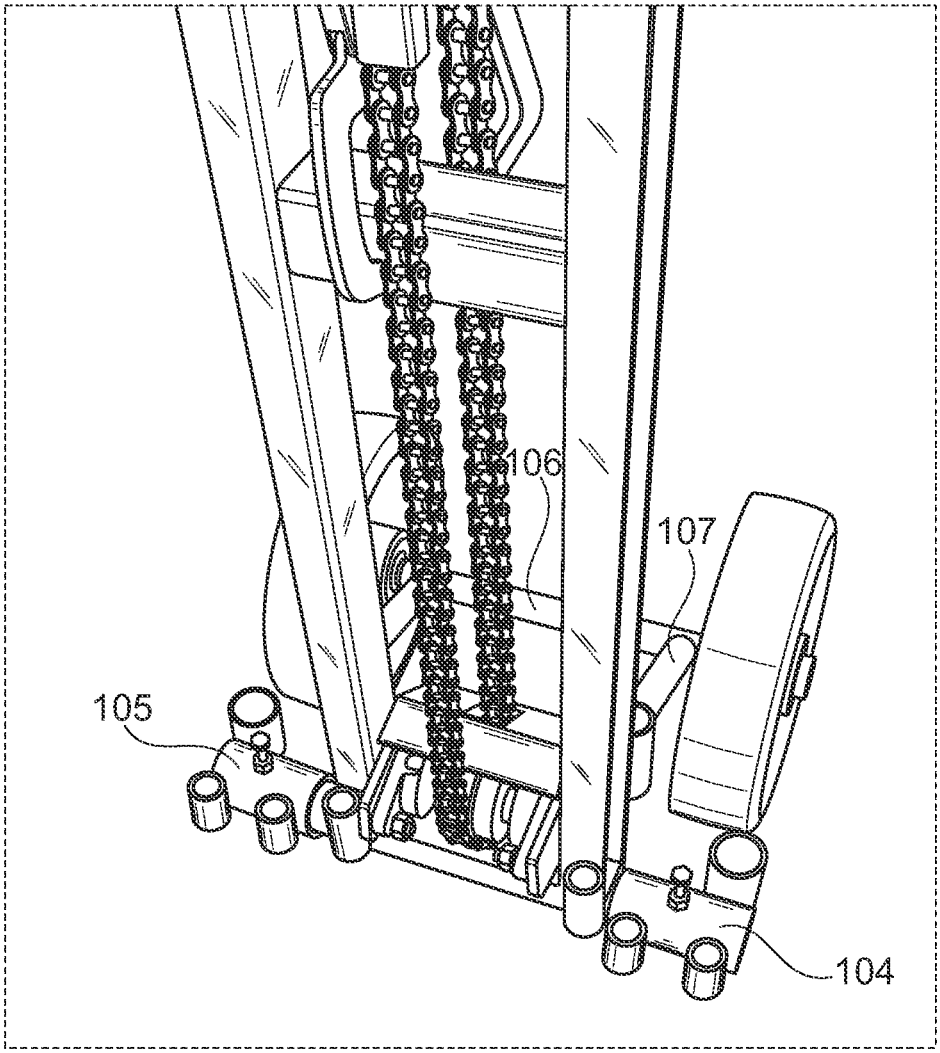
FIG. 7 depicts a back bottom section of a portable body assembly

FIG. 7 depicts a lower sprocket connected to a chain located between the vertical members of the rectangular frame 118. On either side of the lower section of the rectangular frame, head attachments pins 115 comprise a plurality of collars sometimes used to contain stakes or rods driven into the ground. The head attachment pins pivot and allow for the rectangular frame to be secured upon a drill site of any angle.

Figure 8:
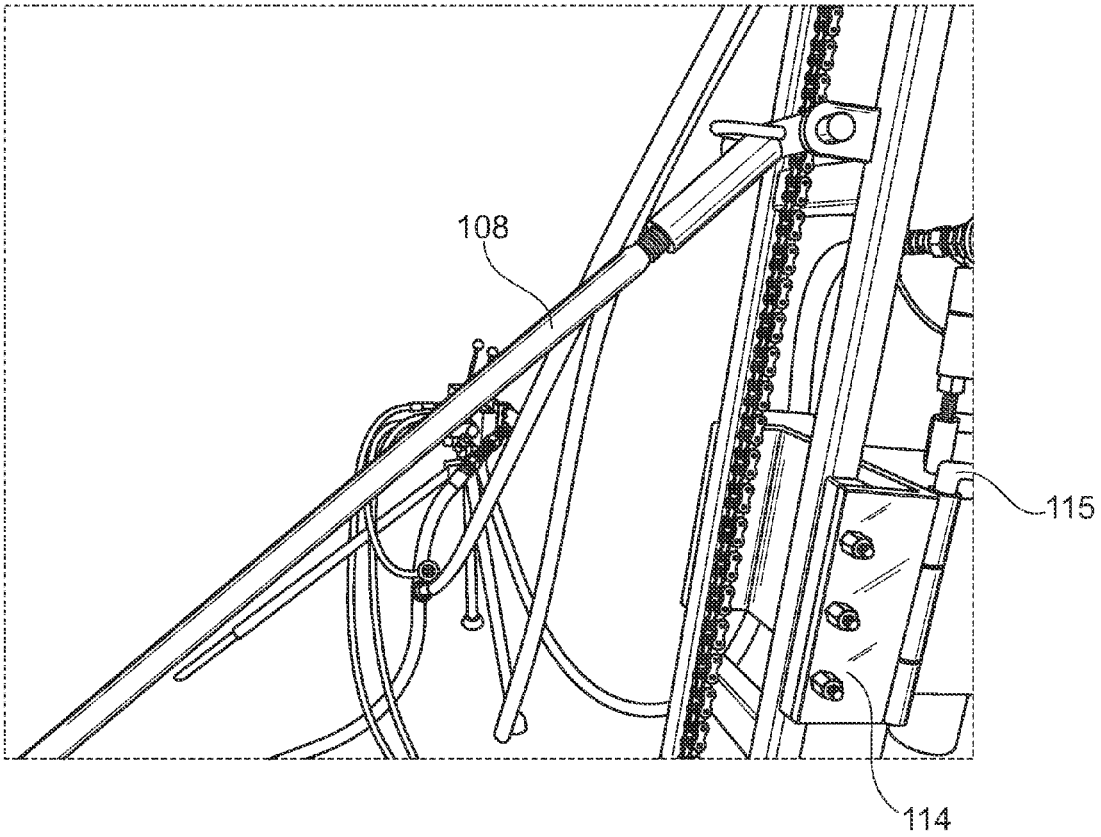
FIG. 8 depicts a back side section of a portable body assembly

FIG. 8 depicts a tripod anchor support 108 in attachment to the rectangular frame 118. The attachment mechanism securing the tripod anchor support 108 to the rectangular frame pivots, allowing for drilling to occur at any angle.

FIG. 8 also depicts a sliding base head 114 secured within the "C" channels 101 of the vertical members 119 of the rectangular frame 118.

Figure 9:
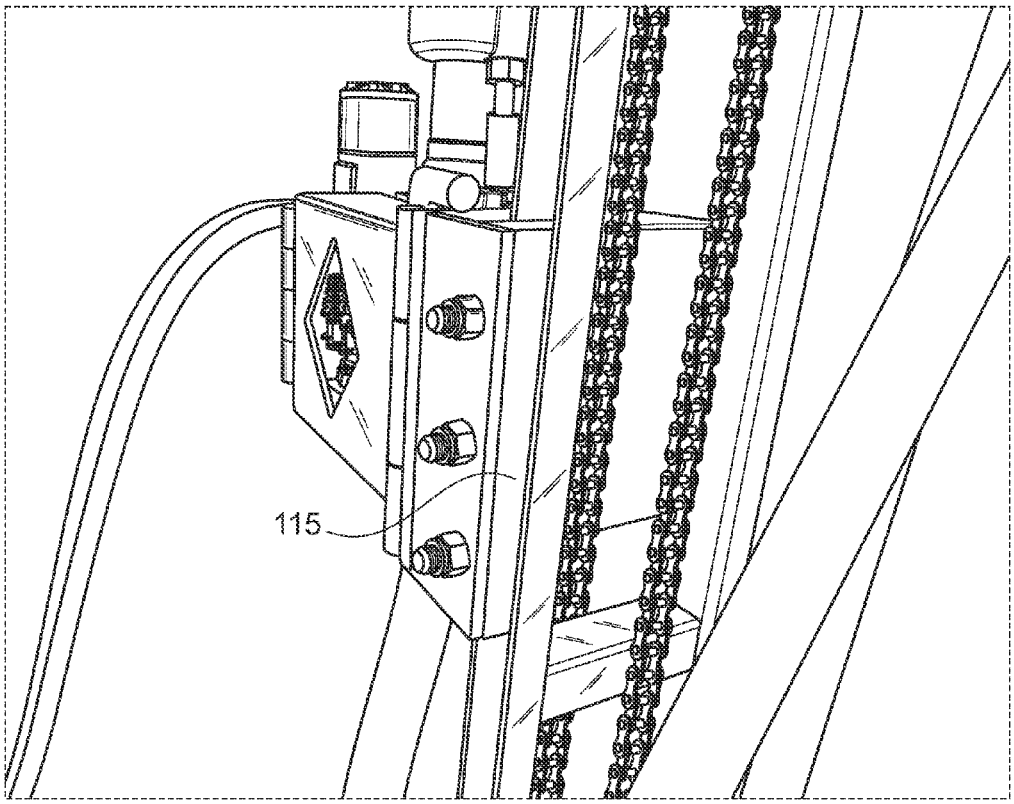
FIG. 9 depicts a back side section of a portable body assembly

FIG. 9 depicts sliding plastic rollers 116 attached to the sliding base head and traveling within the "C" channels. The sliding base rollers may be composed of hard plastic or a plurality of rollers. To achieve smooth function, the length of the hard plastic or series of rollers is approximately equal to the height of the sliding base head. This type of configuration assists in keeping the sliding base head within the "C" channels despite significant vibration caused by drilling.

The back side of the sliding base head is shown in attachment to the chain. The sliding base head is shown in attachment to the head casing 201.

Figure 10:
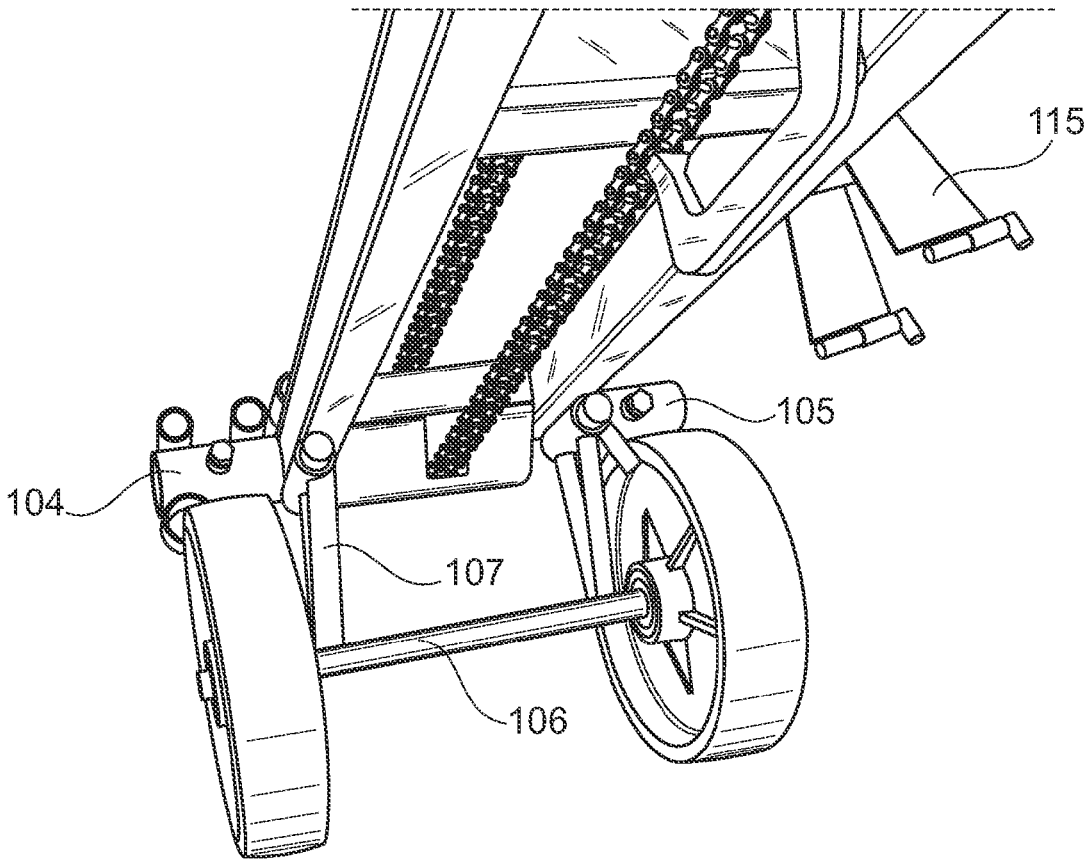
FIG. 10 depicts a back bottom section of a portable body assembly

FIG. 10 depicts a lower back section of a portable body assembly showing a wheel base 106 with wheels on either side and a plurality of wheel base pins 107 securing the wheel base to the rectangular frame 118. This artful configuration allows for the wheels to be quickly removed and for the portable body assembly to be secured in any position to facilitate drilling at any angle.

Figure 11:
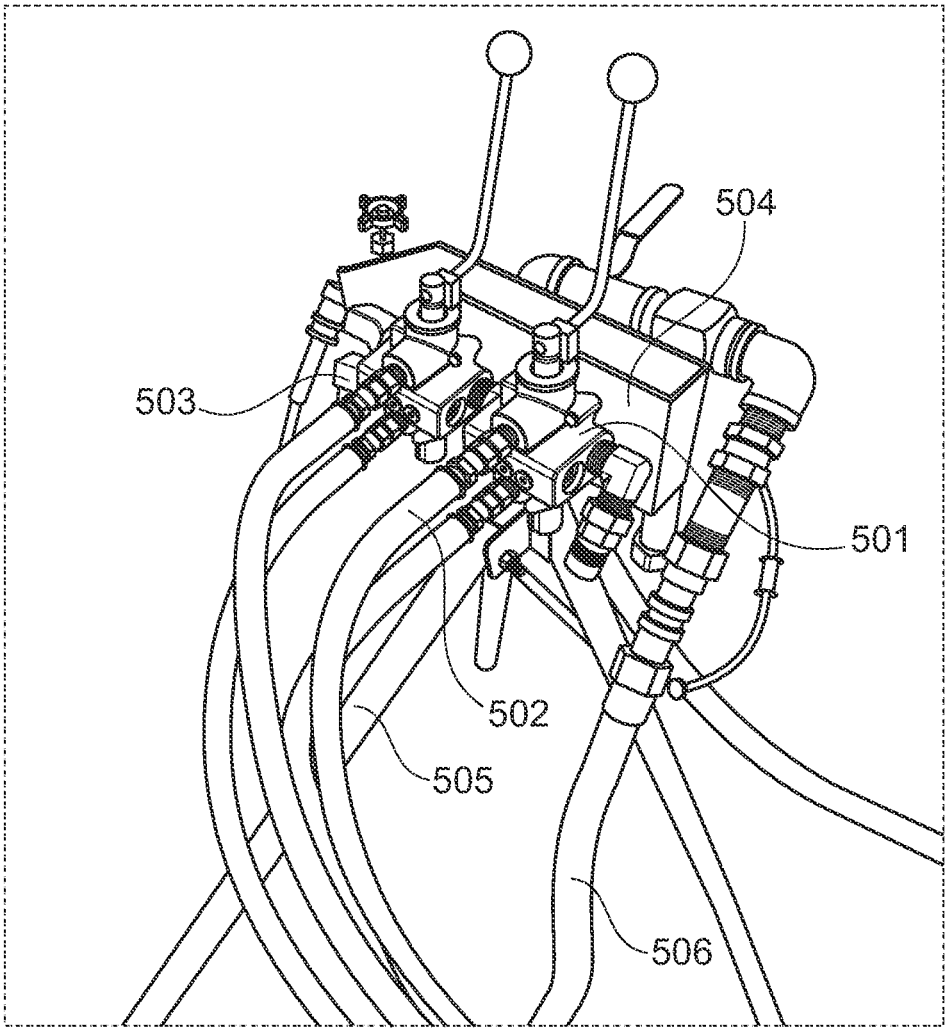
FIG. 11 depicts a front top view of a control assembly

FIG. 11 depicts a front and top view of a control unit 500 which is controls the flow of a plurality of fluids and air flows so as to control the drilling and movement of the portable body assembly 100. A control base 504 may be secured to a control base tripod 505. The control base may be attached to a plurality of control valves 501. In the illustrated embodiment, one control valve adjusts hydraulic pressure to turn the drill head while the other control valve adjusts hydraulic pressure to move the sliding head base 114 along the vertical members 119 of the rectangular frame 118. In the foreground an air compressor inlet 506 leads to a control valve.

Figure 12:
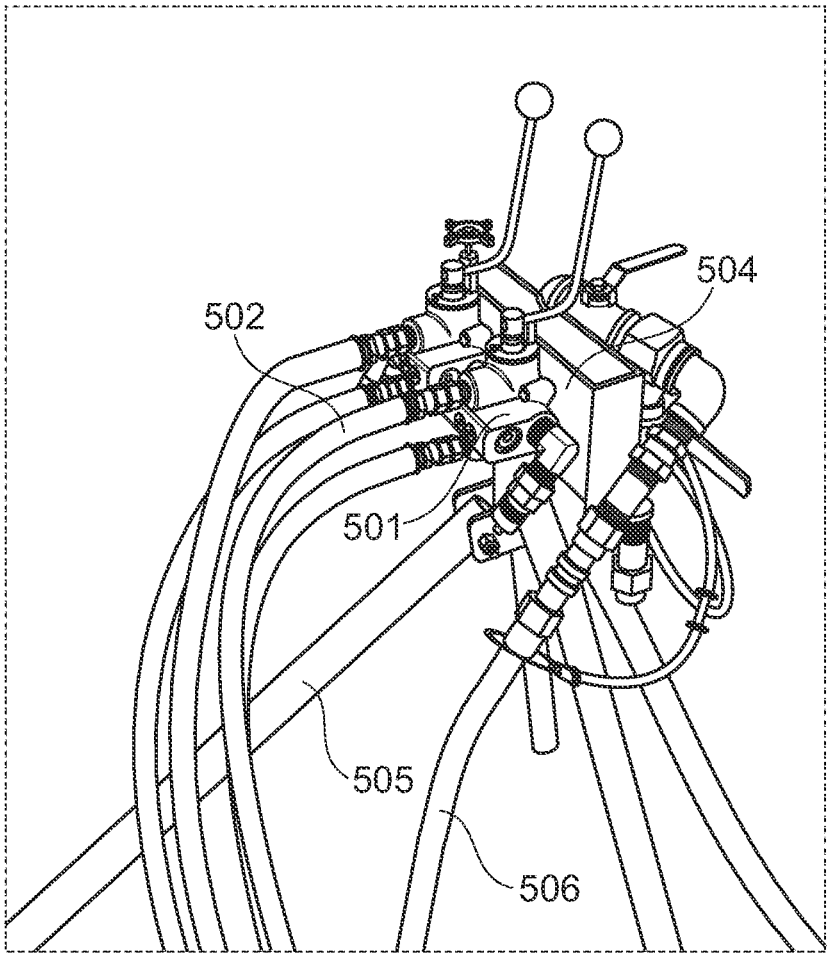
FIG. 12 depicts a side view of a control assembly

FIG. 12 depicts a side view of a control unit 500 and illustrates a leash containing an air compressor inlet hose.

Figure 13:
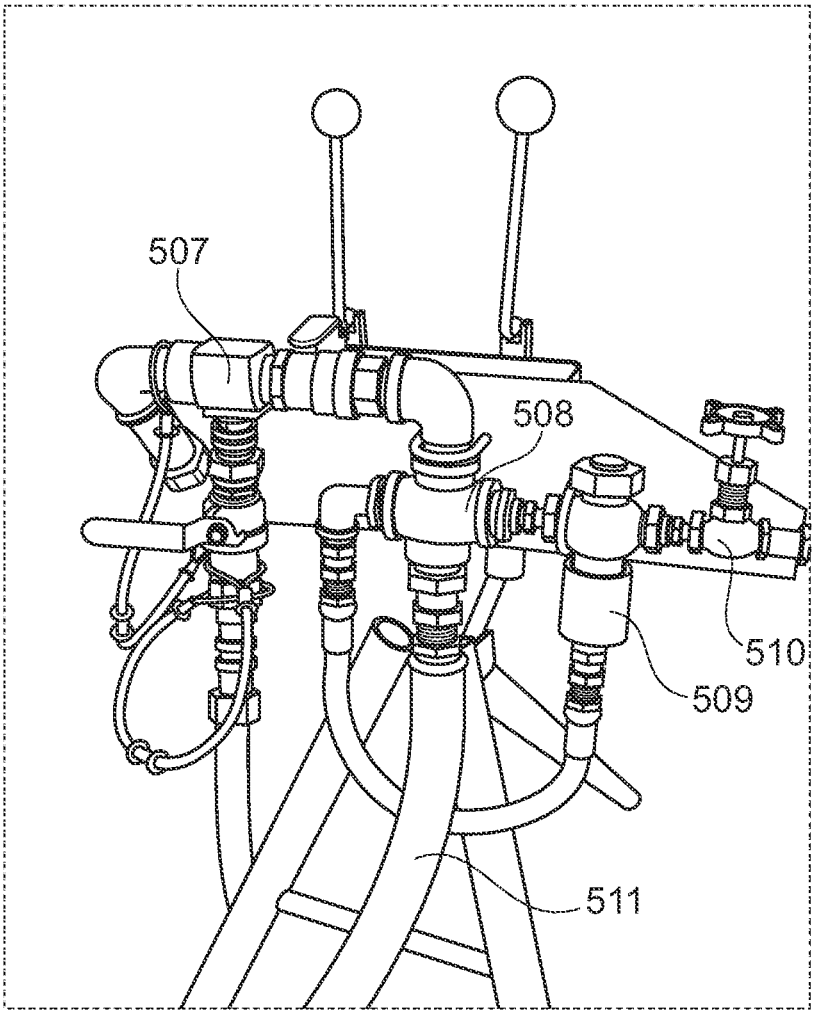
FIG. 13 depicts a front view of a control assembly

FIG. 13 depicts a back side of a control unit 500 and shows an air outlet 507, and a "T" air water mixer and outlet 508 to the swivel of the head casing. A water check valve is in line with a water or hydraulic fluid hose.

Figure 14:
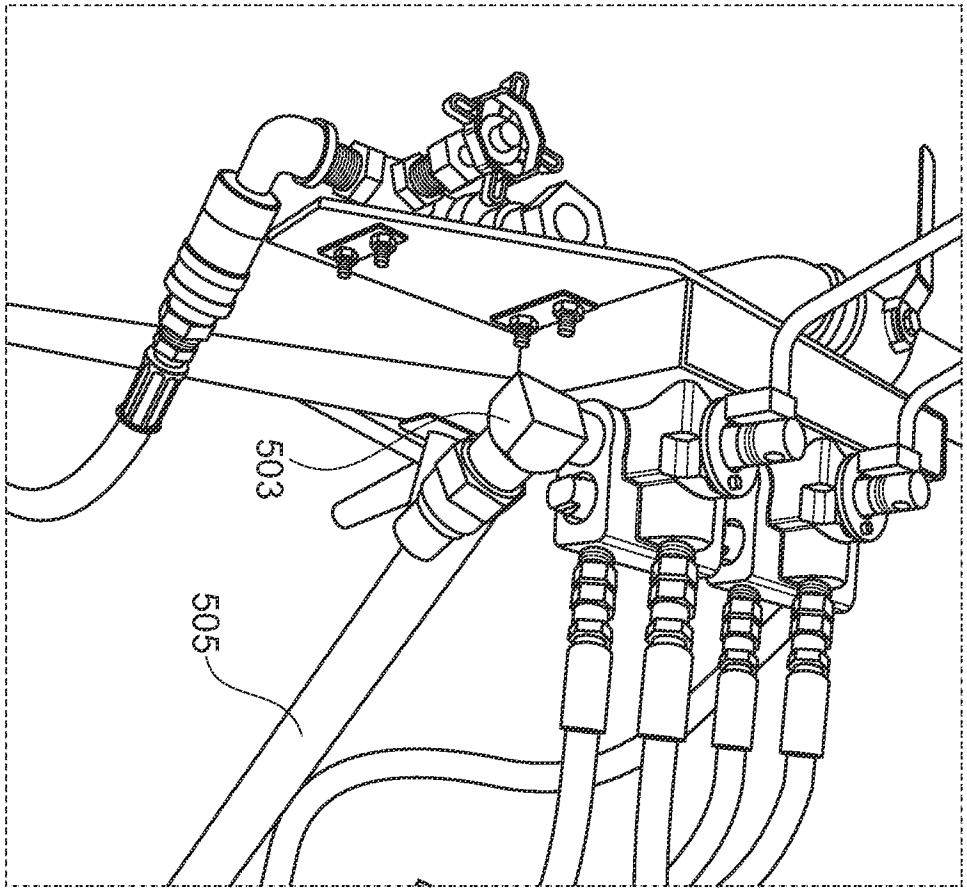
FIG. 14 depicts a side view of a control assembly

FIG. 14 depicts a control base tripod 505 attached to a control base.

Figure 15:
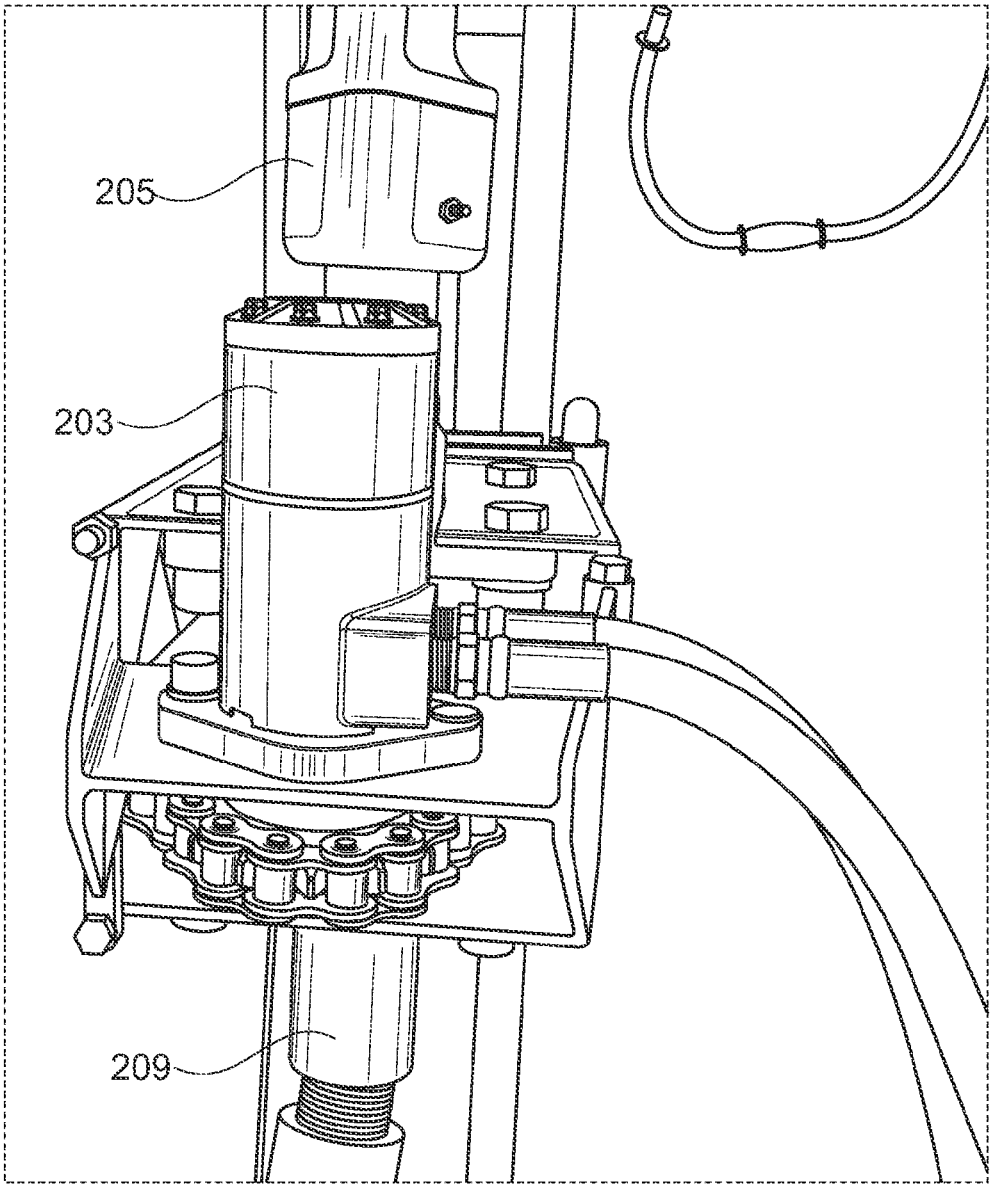
FIG. 15 depicts a hydraulic motor and other parts of a portable body assembly

FIG. 15 depicts a hydraulic motor 202 with the hydraulic motor powered by two hydraulic hoses 204. The hydraulic motor is contained within a hydraulic motor base. The hydraulic motor rotates a sprocket and chain which in turn lead to the head casing 201. The head casing houses a bearing assembly which is rotated by the chain spun by the hydraulic motor. By use of a separate hydraulic motor base and head casing, two portable components configured for easy transport, but also provide air and water hammer capability by use of air and water pressure entering at the top of the head casing.

Figure 16:
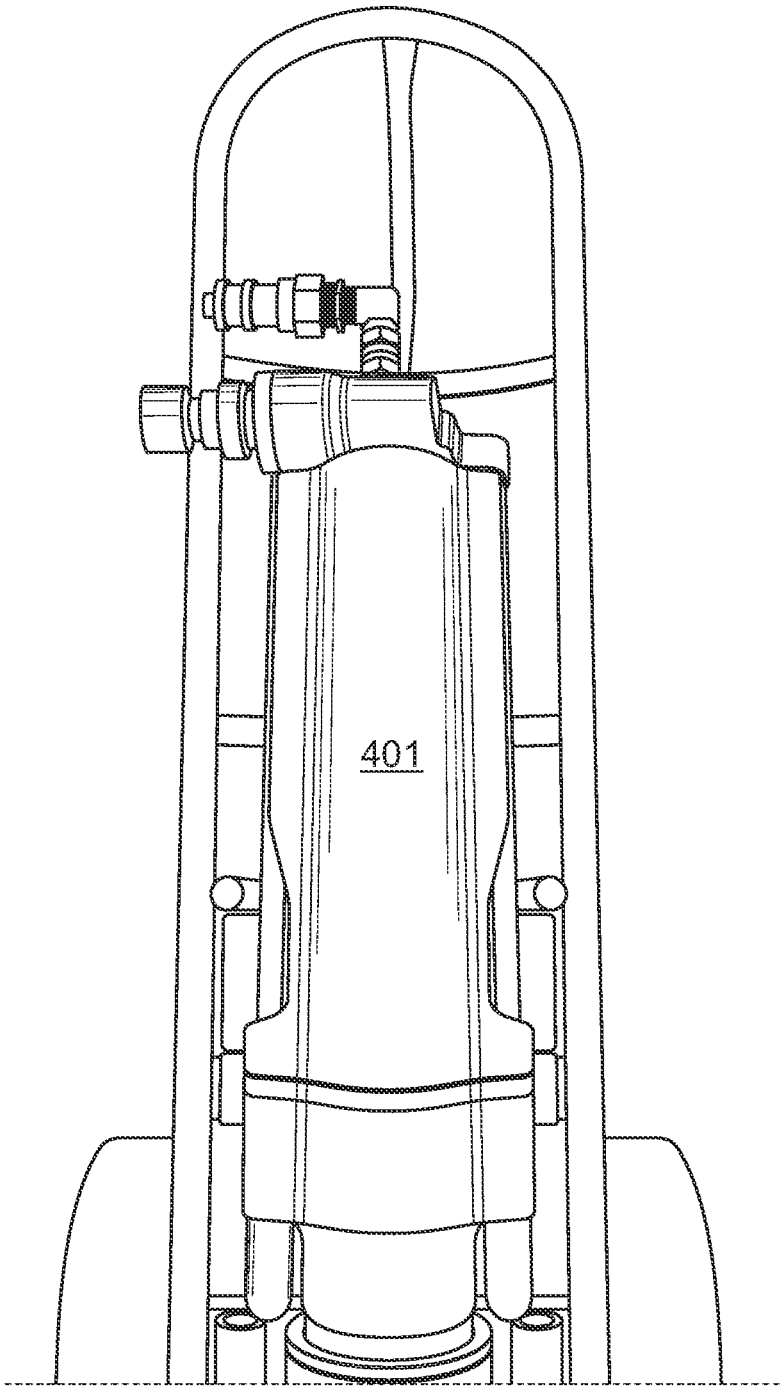
FIG. 16 depicts a tank

FIG. 16 depicts an air compressor unit sometimes used to provide air pressure to a drill head.

Figure 17:
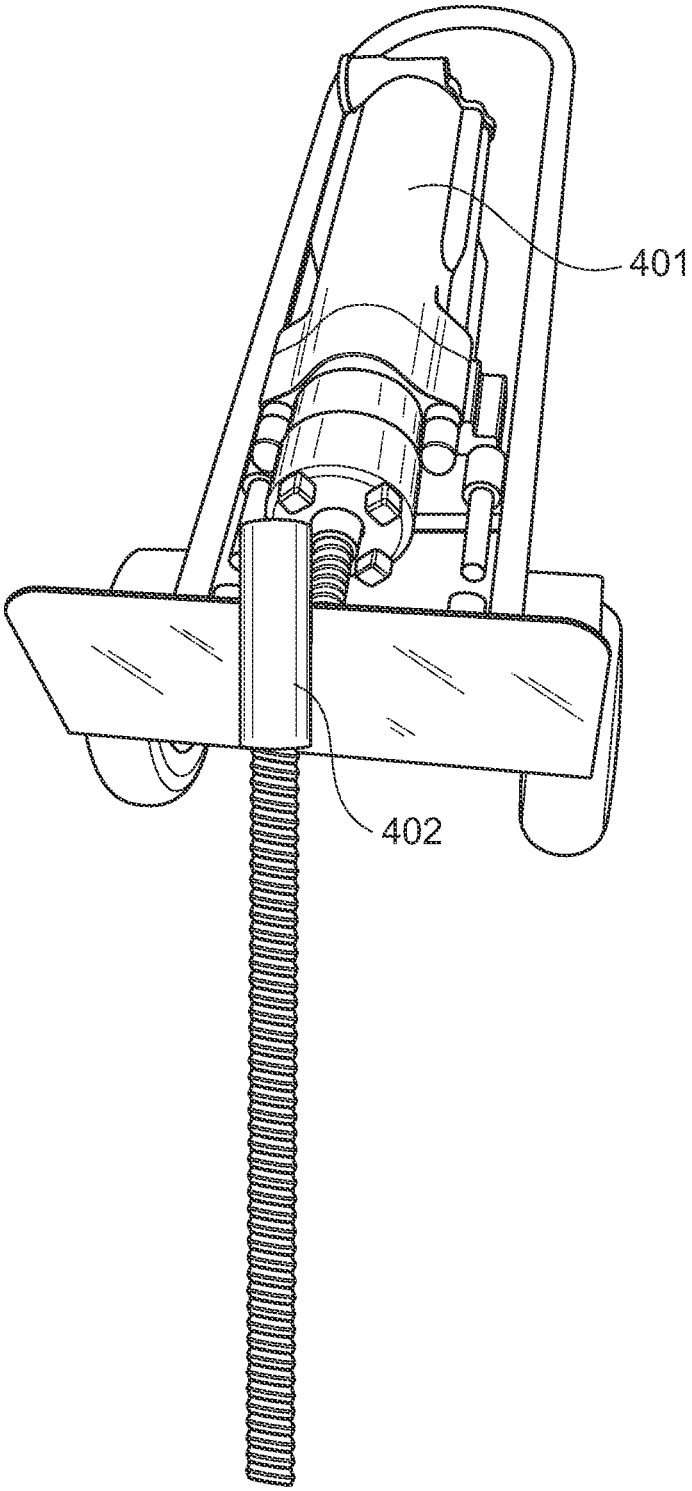
FIG. 17 depicts a tank and rod

FIG. 17 depicts an air compressor unit next to a coupler and rod.

Figure 18:
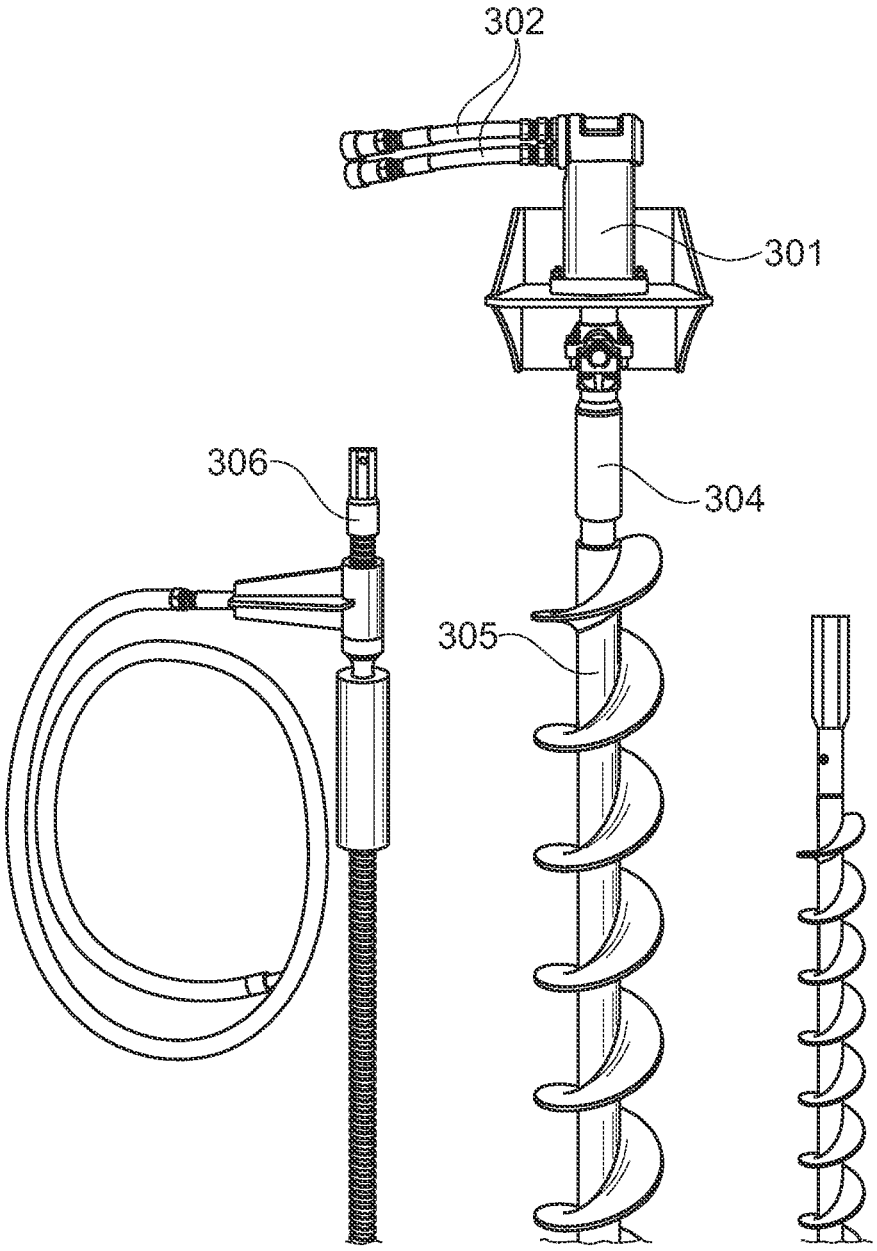
FIG. 18 depicts an auger

FIG. 18 depicts a rotary auger head 300 comprising a hydraulic motor 301 powered from two hydraulic hoses 302. A hydraulic motor base 303 is adjacent to a yoke 304 and coupler attached to an auger which may be hollow to accommodate air and/or water hammer. FIG. 18 also depicts a grout injection swivel for micro piles 306. FIG. 18 also depicts a drifter head.

Figure 19:
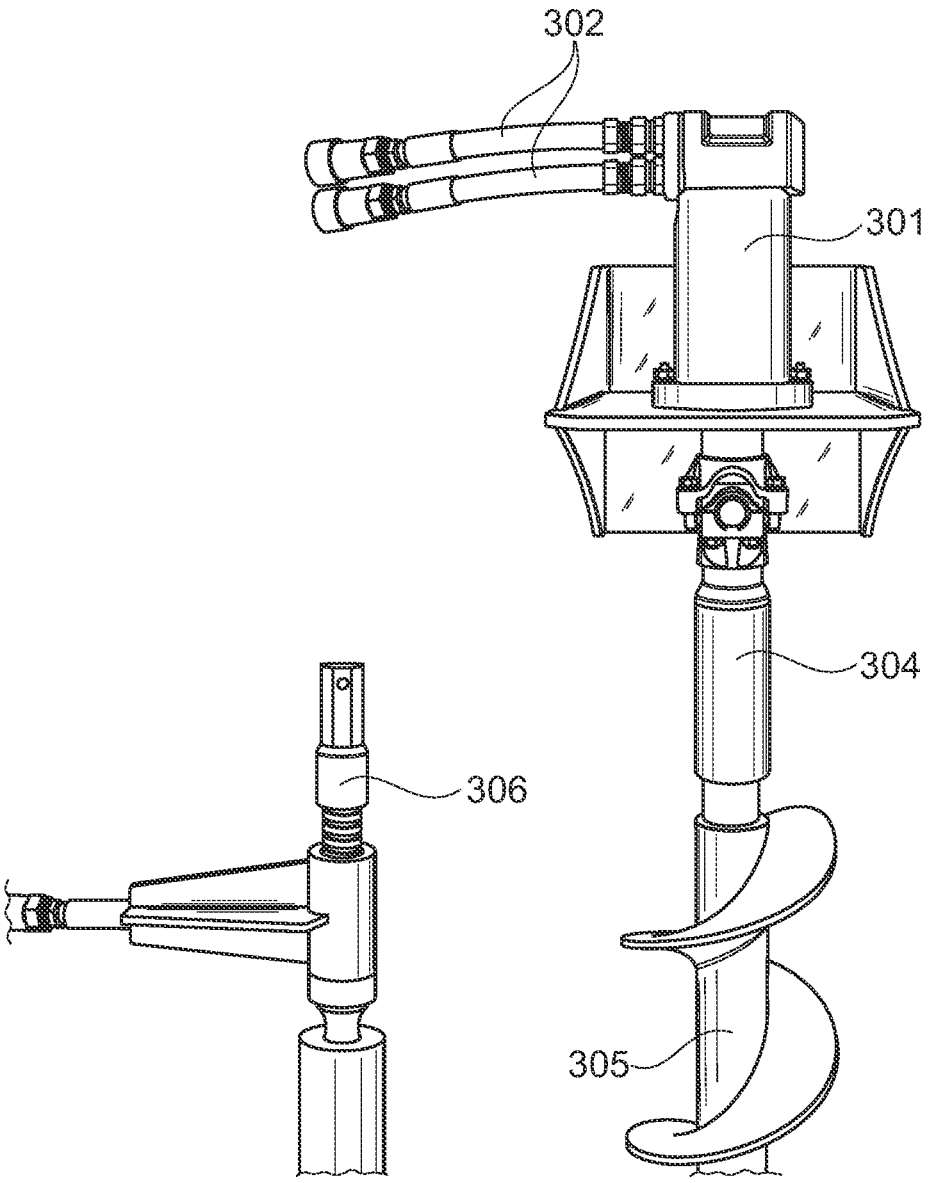
FIG. 19 depicts a rotary auger head and related components

FIG. 19 depicts an expanded view of a rotary auger head 300 which may be used with the disclosed drill rig.

Figure 20:
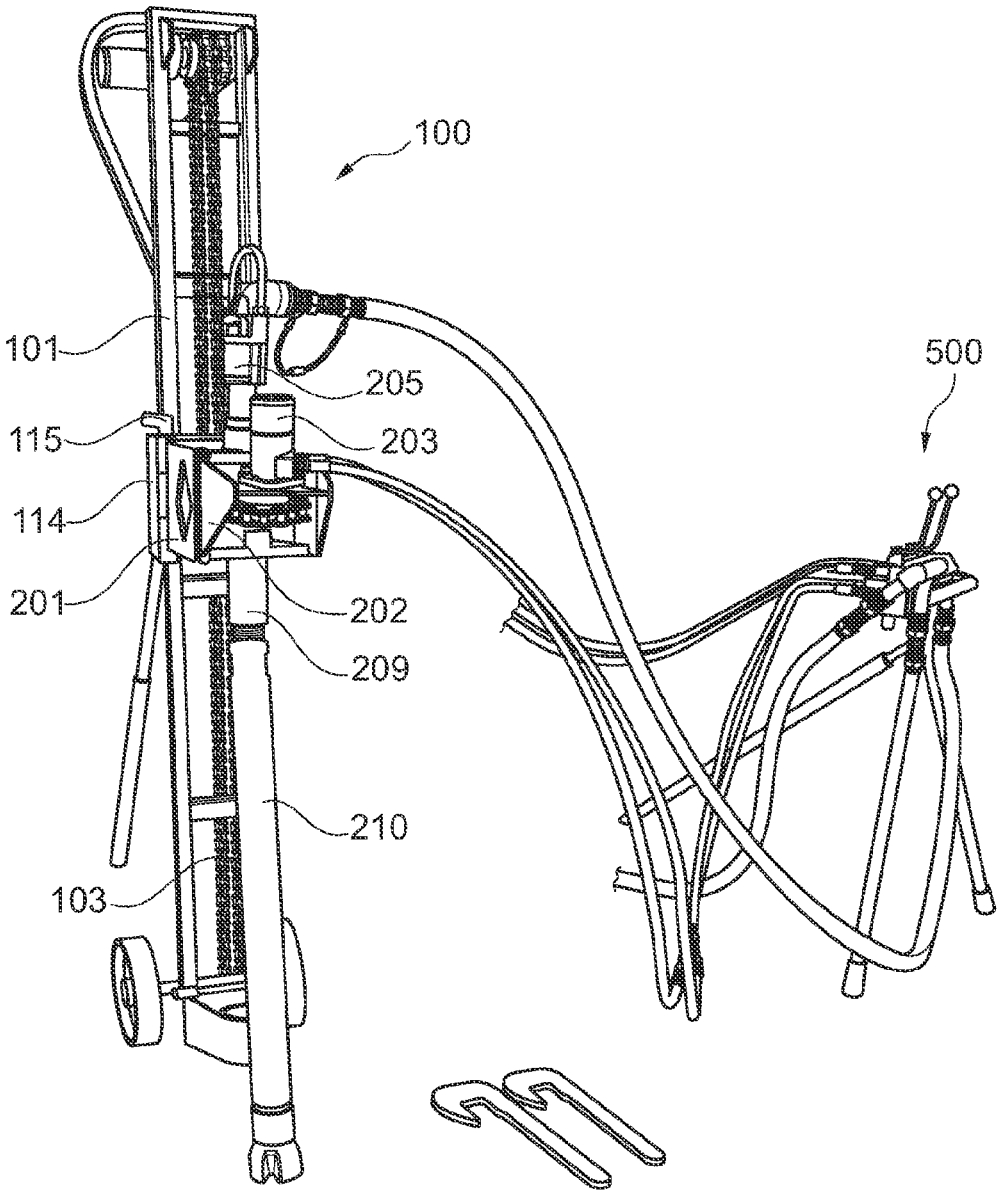
FIG. 20 depicts a perspective view of a portable body assembly with a control assembly

FIG. 20 depicts a plurality of hoses in attachment to a control system 500 and a portable body assembly 100. The separate control system 500 allows for the portable body assembly 100 to consume little space and to be extra portable.

Figure 21:
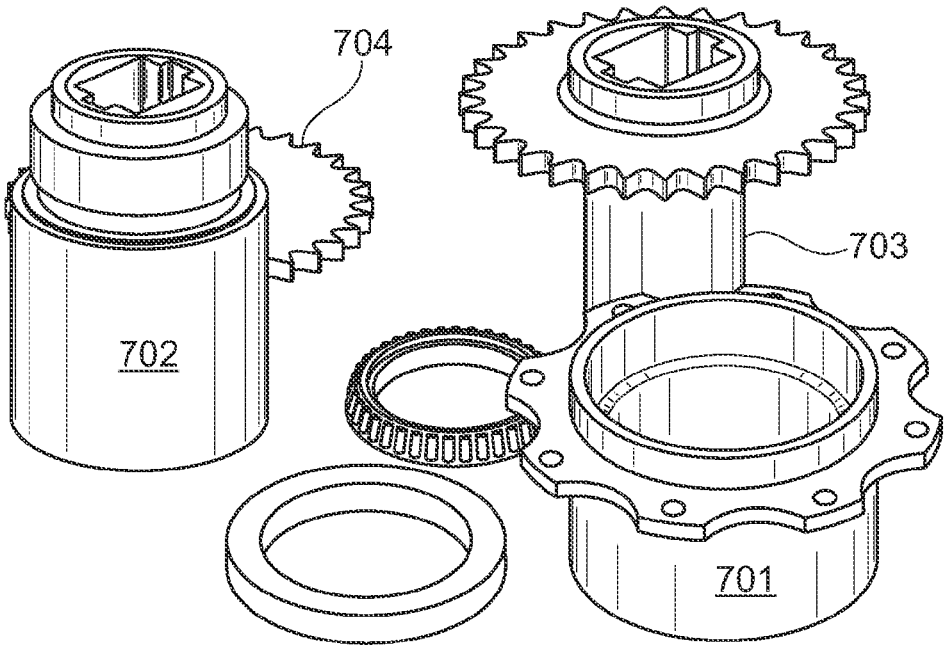
FIG. 21 depicts various bearing assembly components

FIG. 21 depicts various components of a disclosed bearing assembly 700. An outer collar housing 701, inner bearing 702, inner drive shaft with sprocket 703, a second sprocket 704, a first ring 705 and a second ring 706 comprise a disclosed bearing assembly. A disclosed bearing assembly allows water and air to reach a suitably equipped drill head. A disclosed bearing assembly is simple to remove and clean and thus helps with the portability and utility of a disclosed drill rig.

Figure 22:
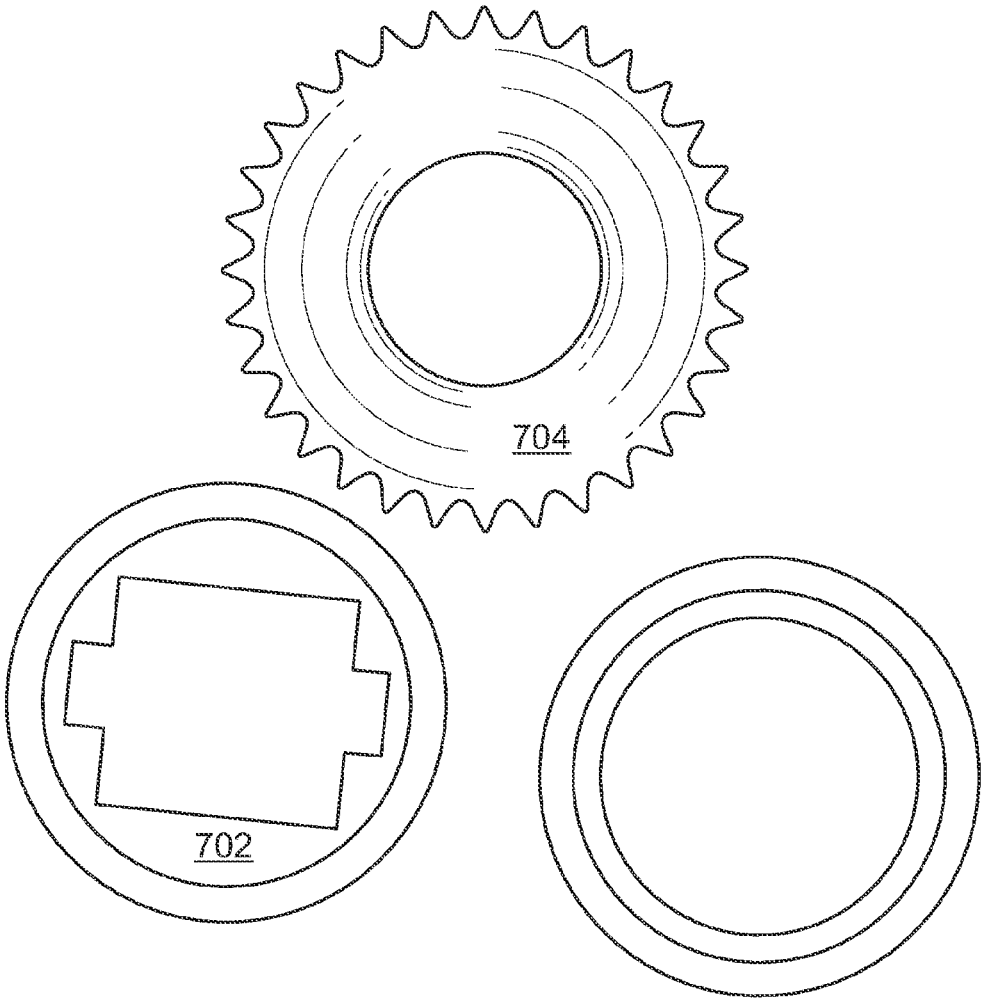
FIG. 22 depicts various bearing assembly components FIG. 23 a depicts a hydraulic motor and other components

FIG. 22 depicts various components of a disclosed bearing assembly.

Figure 23:
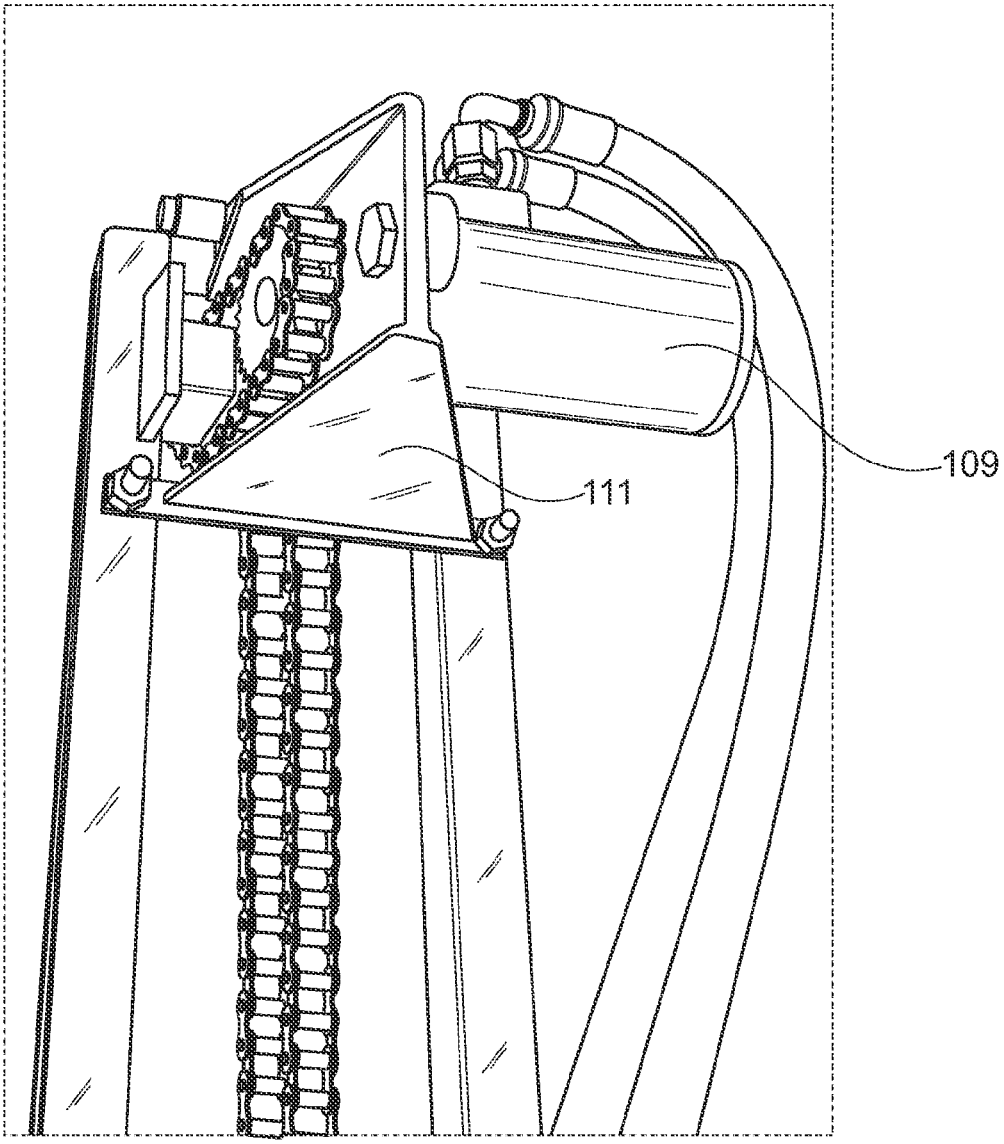

FIG. 23 depicts an upper end of a portable body assembly and illustrates a hydraulic motor base 111 supporting a hydraulic motor 109. The hydraulic motor powers an upper sprocket which moves the chain which moves the sliding head base.

Figure 24:
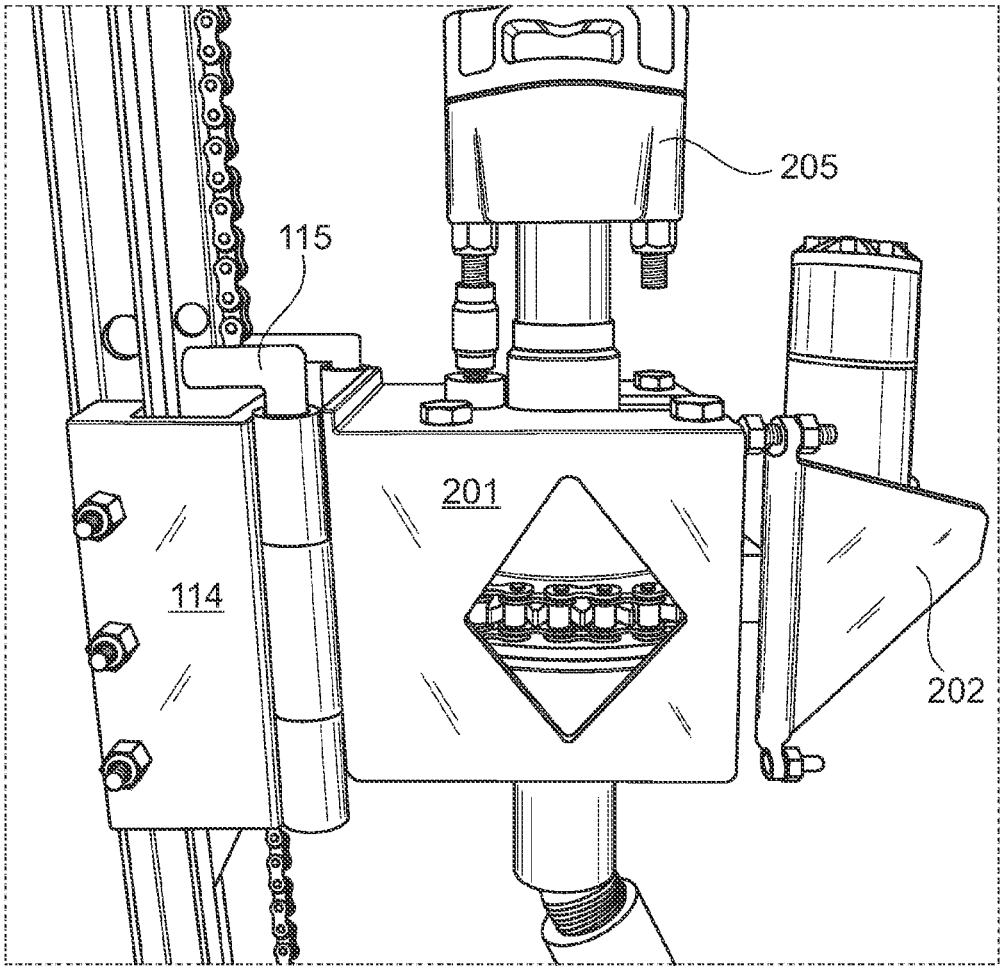
FIG. 24 depicts a head casing and other components

FIG. 24 depicts a side view of a sliding head base 114, with head attachment pins 115 securing the sliding head base to a head casing 201. The head casing is attached with bolts to a hydraulic motor base 202. A sliding head base 114, head casing 201 and hydraulic motor base 202 are sometime collectively referred to as a "drill head assembly" 120.

Figure 25:
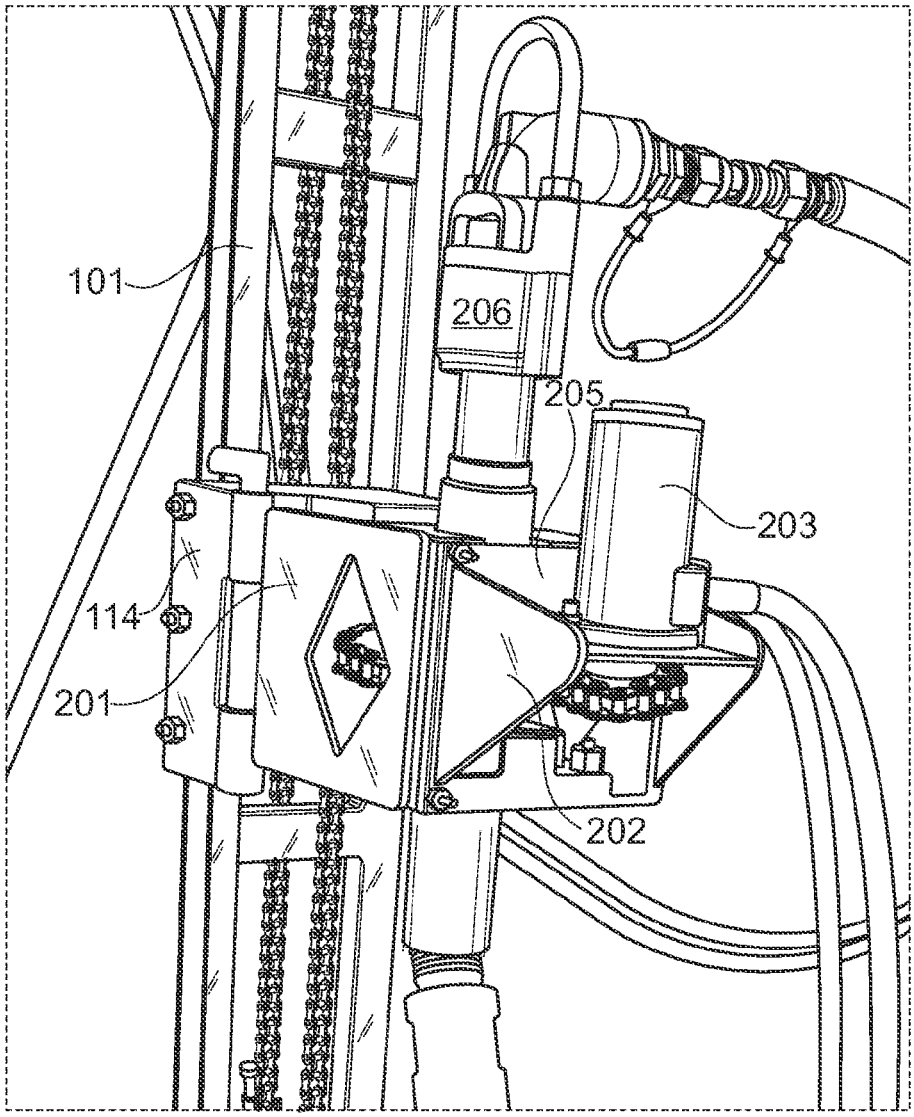
FIG. 25 depicts various components of the portable body assembly

FIG. 25 depicts a swivel 205 in connection to a swivel hub 206 with the swivel hub contained within a head casing 201. A hydraulic motor base 202 is shown in attachment to the head casing 201.

Disclosed embodiments include the following items or descriptions.

Item 1. A drill rig comprising:

a) a drill head assembly 120 comprising i. a sliding head base 114 ii. a head casing 201 iii. a hydraulic motor base 202 b) the drill head assembly attached to a rectangular frame 118, the rectangular frame comprising:

i. two or more vertical members 119, the vertical members attached to cross bars 120.

Item 2. The drill rig of item 1 further comprising hydraulic motor contained within the hydraulic motor base and a bearing assembly contained within the head casing and wherein the hydraulic motor is attached to the bearing assembly.

Item 3. The drill rig of item 2 further comprising a swivel and swivel hub attached to the head casing.

Item 4. The drill rig of item 3 further comprising a bar coupling 209 attached to the head casing.

Item 5. The drill rig of item 4 further comprising a "C" channel 101 within each vertical member 119 and the sliding base head attached to two or more sliding head inserts, the sliding head inserts attached within the "C" channels.

Item 6. The drill rig of item 5 further comprising a chain attached to the sliding base head with the chain attached to top sprocket on a top end of the rectangular frame 118 and the chain attached to a bottom sprocket on a bottom end of the rectangular frame.

Item 7. The drill rig of item 6 further comprising a control unit 500, the control unit comprising a plurality of control valves 501 attached to a control base 504 with the control base attached to a control base tripod 505.

Item 8. The drill rig of item 7 further comprising a plurality of hoses attached to the control unit 500 and drill head assembly 120.

What is claimed is:

1. A drill rig comprising:

a) a drill head assembly comprising;

i. a sliding base head, in sliding connection within two vertical members of a rectangular frame, the sliding head base attached to a first chain, the first chain in rotational attachment to a top end of the rectangular frame and a bottom end of the rectangular frame;

ii. a head casing in pinned attachment to the sliding base, with two hand attachment pins attaching the head casing to the sliding base; with each hand attachment pin comprising a handle, the handle being substantially at a right angle to a vertical body of the attachment pin; the head casing comprising a bearing assembly, the bearing assembly comprising an outer collar housing, an inner bearing, an inner drive shaft with a first sprocket and a second sprocket; the bearing assembly attached to a swivel and the swivel attached to the head casing;

iii. a hydraulic motor base bolted to the head casing, the hydraulic motor base attached to a hydraulic motor, the hydraulic motor attached to a second chain, the second chain attached to the bearing assembly and the bearing assembly attached to a bar coupling b) the bottom end of the rectangular frame attached to a wheel base, wheel base pins, round tube and anchoring foot.

* * * * *